United States Patent [19]

Pillard

[11] 4,202,281

[45] May 13, 1980

[54] POLYVALENT INCINERATOR FOR SOLID AND/OR LIQUID WASTE

[75] Inventor: Jean-Claude L. Pillard, Marseilles, France

[73] Assignee: Entreprise Generale de Chauffage Industriel Pillard, Marseilles, France

[21] Appl. No.: 900,117

[22] Filed: Apr. 26, 1978

[30] Foreign Application Priority Data

Apr. 29, 1977 [FR] France ..... 77 13639

[51] Int. Cl.[2] ..... F23G 5/00

[52] U.S. Cl. ..... 110/259; 110/116; 110/238; 110/258

[58] Field of Search ..... 110/116, 238, 244, 254, 110/258, 259

[56] References Cited

U.S. PATENT DOCUMENTS

| | | | |
|---|---|---|---|
| 2,653,213 | 9/1953 | Comstock | 110/259 |
| 3,742,875 | 7/1973 | Eberle | 110/116 |
| 3,855,951 | 12/1974 | Giles | 110/244 |
| 3,985,085 | 10/1976 | Schroder | 110/238 |

*Primary Examiner*—Edward G. Favors

[57] ABSTRACT

The invention relates to an incinerator which enables solid waste and/or pollutant liquid waste to be destroyed by burning it, and which comprises a combustion chamber, with double metallic envelope provided with an opening for the evacuation of the ashes in the lower part, with a side opening for the loading of the solid waste, with a shaft at the upper end and with a burner which comprises a first supply of liquid fuel and a second supply of pollutant liquid waste which opens out into the burner.

8 Claims, 3 Drawing Figures

POLYVALENT INCINERATOR FOR SOLID AND/OR LIQUID WASTE

The present invention relates to a polyvalent incinerator for solid and/or liquid waste.

Incinerators for household refuse or solid industrial waste are known which comprise a grate and a burner intended to produce a flame for drying the waste and for activating combustion thereof, said waste being converted on the one hand into ashes and on the other hand into gases.

Devices for destroying residues or liquid effluents by injecting them into a flame are also known. In particular, burners are known which are supplied by an atomised liquid hydrocarbon, which comprise means for atomising, at the same time as the hydrocarbon, one or more residual liquids which form, with the hydrocarbon, an emulsion.

So-called rotary cupel burners are also known which comprise a hollow cupel, which is driven in rotation and against which are projected jets of liquid hydrocarbon and jets of a pollutant liquid which is destroyed in the flame of the burner.

It is an object of the present invention to provide a polyvalent incinerator enabling either waste or household refuse in the solid state, liquid pollutant residues or effluents, or both at the same time, to be destroyed.

Another object of the present invention is to provide a non-bulky polyvalent incinerator intended more particularly to fit ships, and in particular oil tankers or ships fitted with tanks for transporting pollutant or dangerous liquid products. In fact, it is known that the International Convention on the Prevention of Marine Pollution of 1973 prohibits the dumping into the sea of any solid waste or pollutant liquid.

The invention has for its object to provide a single, polyvalent apparatus making it possible to destroy, by incineration, both solid waste such as household refuse and pollutant liquids such as sewage water, waste water, sludge, used oils, water containing suspended matter or pollutant liquid, for example traces of hydrocarbons. Of course, this application is non-limiting.

An incinerator according to the invention comprises, in known manner, a combustion chamber essentially equipped with a grate in its lower part, an opening for loading the solid waste, a shaft, a burner and with a supply of liquid hydrocarbons for said burner.

The objects of the invention are attained by means of an incinerator provided with a burner which further comprises means for intimately mixing pollutant liquids with the hydrocarbons inside the burner, in order to destroy said pollutant liquids in the flame.

Thus, an incinerator according to the invention is polyvalent, i.e. it allows solid waste, pollutant liquids or both at the same time, to be destroyed, this making it possible to fight against all forms of pollution, with one single apparatus. The burner fulfills a double function. In the case of the incinerator being used solely for destroying solid waste, the burner is supplied solely with hydrocarbons and the flame of the burner serves to dehydrate then to burn this waste. In the case of it being desired to destroy liquid residues, for example sewage or waste water, either separately or at the same time as the solid waste, these residues are injected into the second circuit of the burner with a controlled rate of flow.

The combustion chamber is preferably a vertical cylindrical vat, the burner opens out tangentially into said vat and the shaft is located at the upper end of the vat, so that the flame and the combustion gases follow a helical path inside the vat.

In a preferred embodiment, the combustion chamber comprises a double vat made of metal, which is lined on the inside with a relatively thin refractory layer and which defines an intermediate space between the two envelopes, in which a stream of fresh air circulates.

According to a preferred embodiment, the burner is a rotary cupel burner which comprises a hollow shaft driven in rotation, a hollow cupel, which is mounted by means of radial blades on a hub fixed to the front end of said hollow shaft, a stationary tube which is engaged inside said hollow shaft, the rear end of which is connected to a pollutant liquid circuit and the front end of which, which passes beyond the front end of said hollow shaft, comprises radial orifices which open inside said cupel and a stationary hydrocarbon inlet pipe which penetrates inside said cupel, through the rear end thereof and which comprises, inside said cupel and behind said hub, a section which envelopes a part of the periphery of said hollow shaft and which comprises orifices for injecting hydrocarbon, directed forwardly.

The invention results in a novel polyvalent incinerator which enables both solid waste and pollutant liquid residues to be eliminated by converting them by fire into non-pollutant ashes and into gases.

An incinerator according to the invention may be produced in a non-bulky form which is particularly suitable for fitting ships.

In fact, the helical path of the flames inside the combustion chamber enables the path thereof to be extended without increasing the volume of the chamber and ensures a complete combustion of the solid particles before rejection to the atmosphere. Moreover, an effect of cyclone is produced in the chamber which promotes the separation of the gases and the solid particles of ashes which drop into the bottom of the chamber.

The use of a rotary cupel burner makes it possible efficiently to destroy liquid effluents, which are or are not combustible, for example waste water or sewage water containing impurities in suspension and to remove said latter whilst respecting anti-pollution regulations.

The presence of a double vat made of steel with circulation of fresh air in the intermediate space makes it possible to reduce the thickness and weight of the refractory materials, this facilitating periodic replacement thereof.

The reduction in thickness of the refractory layer leads to a gain in volume of the combustion chamber for the same total dimensions.

Moreover, the temperature of the external sheet metal remains low, this avoiding risks of the staff being burnt or risks of fire.

Finally, the thermal inertia of the apparatus is reduced, this leading to a shorter heating time, hence a saving of fuel.

The design of the grate makes it possible, on the one hand, to break up the solid waste, particularly the blocks of cinders and, on the other hand, to have an opening of large section to evacuate said blocks after having pivoted the rotary grate through 90°.

The invention will be more readily understood on reading the following description with reference to the accompanying drawings, in which.

Figure 1:
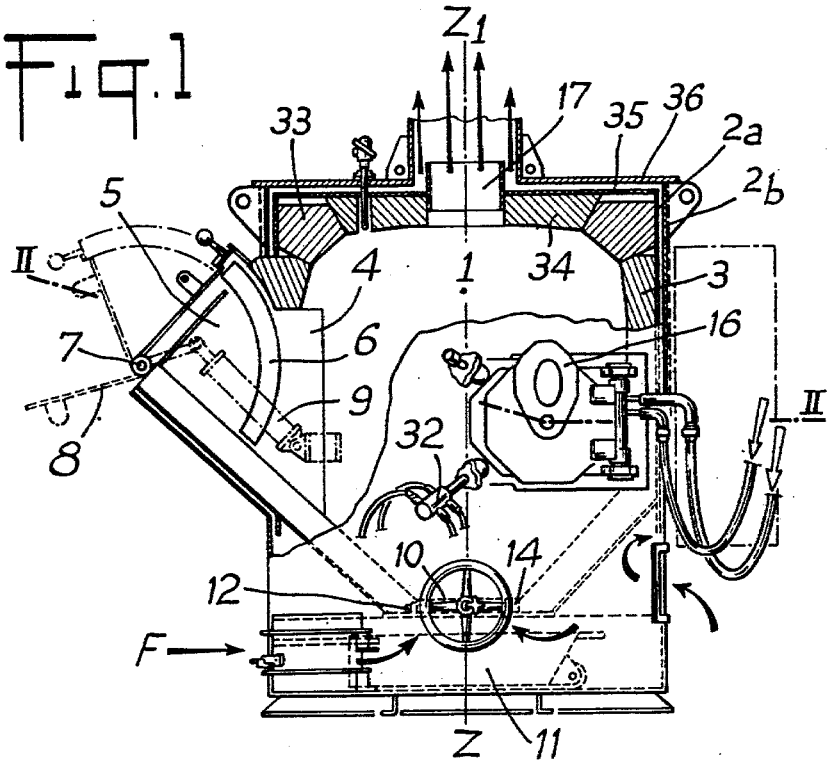
FIG. 1 is a vertical view with parts torn away.
Figure 2:
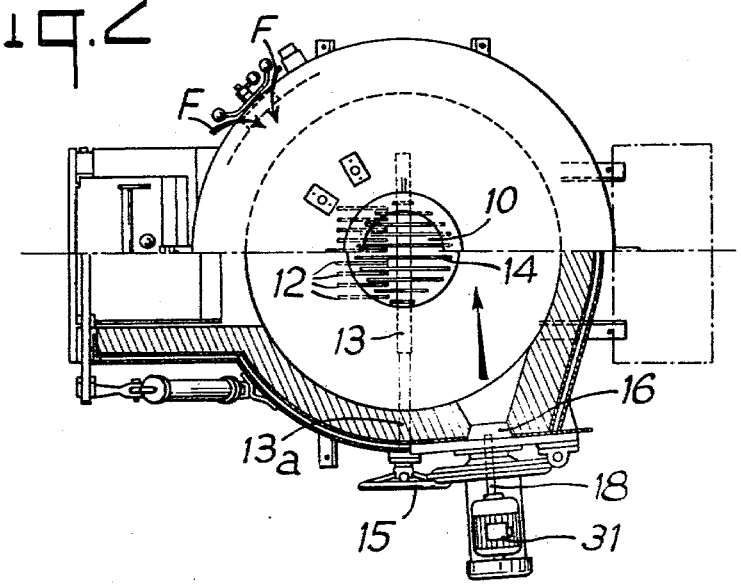
FIG. 2 is a half horizontal section along II—II.

Referring now to the drawings, FIGS. 1 and 2 show an incinerator according to the invention comprising a combustion chamber 1 which is delimited by a vertical cylindrical vat 2, of axis z zl, composed of two metallic envelopes 2a, 2b which define an intermediate space in which circulates a stream of fresh air forming an insulating cushion. The vat is lined on the inside with a relatively thin refractory coating 3, of low calorific inertia. This vat comprises a side opening 4 which serves to introduce into the vat solid waste, for example household refuse. The opening 4 is provided with a chamber 5 composed of a cylindrical sector 6 pivoted about an axis 7 and of a pivoting door 8. The door enables the waste to be introduced into the chamber. The door is then closed, and a penumatic jack 9 causes the chamber to pivot towards the outside so that the waste falls into the combustion chamber.

The bottom of the chamber is in the form of a conical hopper and comprises an opening closed by a grate 10 beneath which is placed a pan 11 for recovering the ashes.

FIG. 2 shows the construction of the grate 10. It is composed on the one hand of stationary bars 12 parallel to one another and, on the other hand, of a rotating shaft 13, perpendicular to the bars 12, which bears pairs of arms 14 which extend radially on either side of the shaft 13 and which are inserted between the bars 12. The shaft 13 is disposed substantially along a diameter of the vat 2. The stationary bars 12 are located on the same side of the shaft 13 as the loading opening 4, with the result that the solid waste coming from opening 4 drops onto the stationary grate. The bars 12 and arms 14 are preferably constituted by flat bars placed edgewise, i.e. in a vertical plane.

One of the ends 13a of the shaft 13 passes through the refractory coating and the double wall of the vat to arrive at the outside thereof. This end is fitted with a wheel 15 or handle which enables the shaft 13 to be rotated in the two directions. It is thus possible to break up the solid residues by shearing them between the stationary bars 12 and the arms 14; they are then evacuated towards pan 11 by rotating the shaft through 90°, this releasing the half-opening placed on the side of the shaft 13 opposite the stationary bars 12.

The incinerator comprises an air inlet beneath the grate 10 in the direction of arrow F, to activate combustion of the solid waste.

The incinerator according to the invention comprises a burner 16 which opens out tangentially into the combustion chamber 1.

It further comprises a shaft 17 which is located at the upper end of the chamber 1. Thus, the flames and the combustion gases follow a helical path inside the vat to pass from the burner to the shaft. This arrangement is important as it allows the path of the gases in the chamber to be extended for a given incinerator volume.

According to a feature of the invention, the burner 16 comprises two separate circuits which make it possible intimately to mix, inside the burner itself, a liquid hydrocarbon serving as fuel and possibly a flow, determined in proportion to the flow of fuel, of a second liquid which is constituted by an effluent or a pollutant residue which is to be eliminated.

Figure 3:
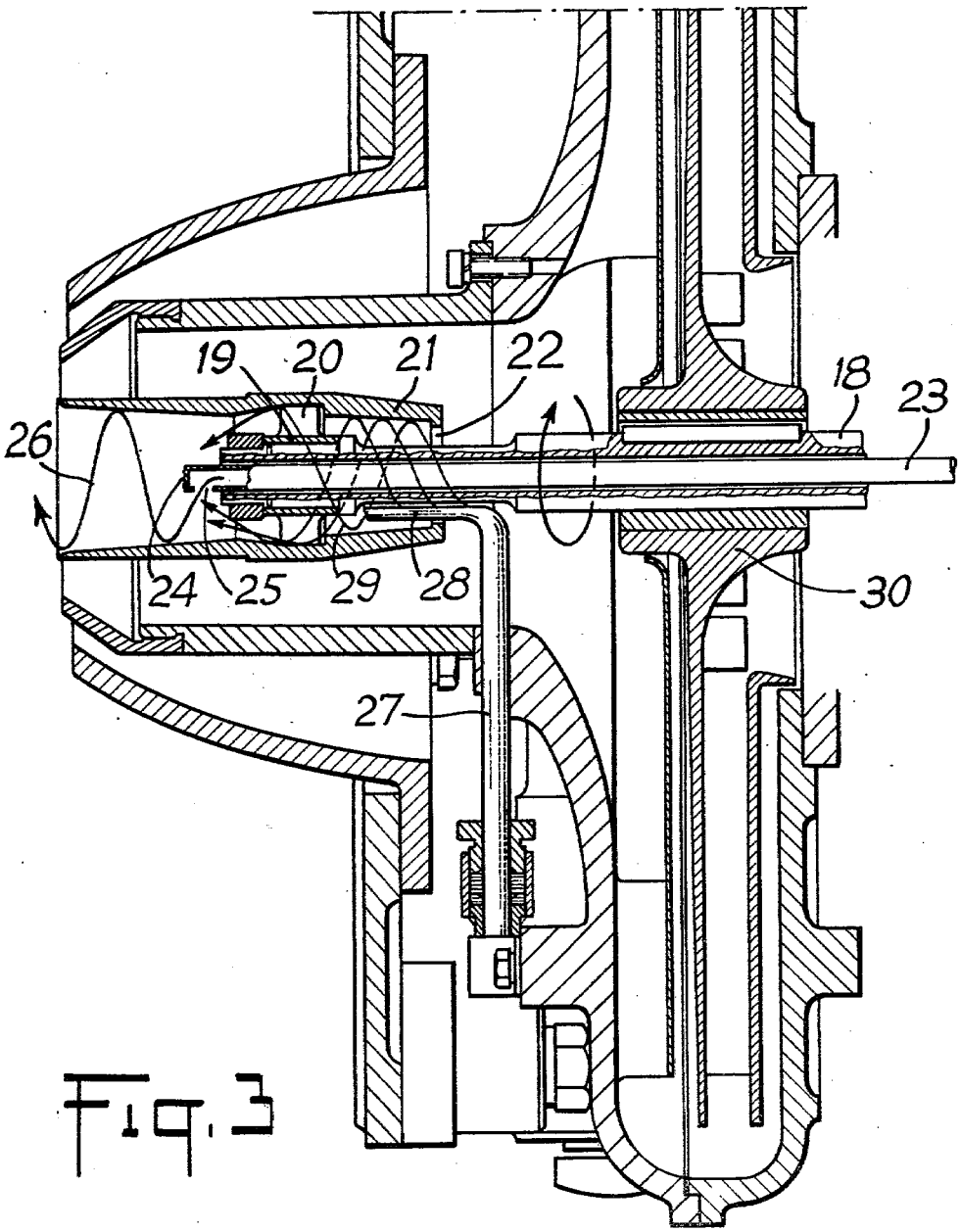
FIG. 3 is a view in section of a rotary cupel burner.

FIG. 3 shows by way of non-limiting example a longitudinal section through a type of burner 16 which is used for equipping an incinerator according to the invention. This so-called rotary cupel burner comprises an electric motor (not shown) which drives a hollow shaft 18.

The front end of this shaft supports the hub 19, equipped with radial blades 20 and with a rotary cupel 21 constituted by a cylindrical or cylindro-conical, hollow chamber, open at the front end. This chamber envelopes the front end of the hollow shaft and passes beyond said end at the front. The rear end of the cupel 21 comprises an annular opening 22 around the hollow shaft. A stationary tube 23 is engaged inside the hollow shaft 18.

The rear end of this tube (not shown) is connected to a pollutant liquid inlet pipe, for example waste water or water containing impurities in suspension or in solution.

The front end 24 of the tube 23 emerges from the rotary shaft inside the cupel 21. It is obturated at the end and comprises one or more radial orifices 25 through which the pollutant liquid is injected against the walls of the rotary cupel so that it follows a helical path 26.

The burner comprises a second stationary pipe 27 which penetrates inside the cupel through the annular orifice 22. This pipe is connected to a hydrocarbon inlet. It comprises, inside the rear part of the cupel, a rectilinear section 28, parallel to the hollow shaft of flattened form which envelopes a part of the periphery thereof. This section comprises, on its inner face, and at the front, hydrocarbon injecting orifices. The hydrocarbon follows helical paths 29 inside the cupel, it is mixed by the radial blades 20 and it is intimately mixed with the liquid containing impurities before being injected into the combustion chamber. The burner further comprises a fan 30, mounted on the shaft 18, which sends combustion air around the rotary cupel, the functioning of the assembly being ensured by a motor 31.

An incinerator according to the invention further comprises one or more firing burners 32, supplied with hydrocarbon.

The upper end of the combustion chamber 1 is obturated by a dismountable top in order to facilitate the periodic replacements of the refractory lining and operations inside the chamber.

This top is composed of a refractory ring 33 which is placed on top of the refractory lining 3 of the vertical walls. This ring delimits a central circular opening whose edges are truncated and upwardly divergent. This opening receives a truncated stopper 34 made of refractory material, likewise upwardly divergent, which is placed in said opening. This stopper is pierced at its centre and carries the shaft 17. This top is completed by two removable metallic lids 35 and 36, separated by a tongue of air.

By way of numerical example, with no limiting character, an incinerator according to the invention having a diameter of about 1.40 m and a vat height of 2 m weighs about 3 tons. It may burn between 50 kgs/h and 80 kgs/h of solid waste and up to 150 kgs/h of pollutant liquids (oils, sludge, water containing impurities). The average fuel consumption (domestic fuel oil being used) is about 30 kgs/h.

Of course, without departing from the scope of the invention, the various elements constituting the incinerator which has just been described by way of example may be replaced by equivalent elements fulfulling the same functions.

What we claim is:

1. A polyvalent incinerator for solid and/or liquid waste comprising a vertical and cylindrical combustion chamber provided with an opening for the evacuation of the ashes which is located in the bottom and which is fitted with a grate; with an opening for the loading of solid waste; with a chimney shaft which opens out at the upper end of said chamber; and with one single burner which opens out tangentially in said chamber, which burner comprises both means for supplying it with liquid fuel and means for intimately mixing pollutant liquid waste with said fuel inside said burner.

2. An incinerator as claimed in claim 1, in which said combustion chamber is composed of two metallic envelopes which delimit therebetween a free intermediate space in which circulates a stream of fresh air and the inner face of the inner envelope comprises a thin refractory coating.

3. A polyvalent incinerator for solid and/or liquid waste comprising a combustion chamber provided with an opening for the evacuation of ashes; with an opening for the loading of solid waste; with a chimney shaft; and with a single burner, wherein said burner comprises:

a hollow shaft which has a front end and a rear end and which is driven in rotation;

a hub fixed to said hollow shaft, near the front end thereof, radial blades which are fixed to said hub;

a rotatable chamber coaxial with said hollow shaft, which is fixed to said radial blades and which passes beyond the front end of said hollow shaft;

and a stationary tube which is engaged inside said hollow shaft, which stationary tube has a rear end which receives pollutant liquid waste and a front end which passes beyond the front end of said hollow shaft and which comprises radial orifices which open out inside said rotatable chamber.

4. An incinerator as claimed in claim 3, in which the rear end of said rotatable chamber is separated from said hollow shaft by an annular opening and said burner further comprises a second stationary pipe for supplying liquid fuel, which penetrates inside said rotatable chamber through said annular opening, which second stationary pipe comprises, inside said rotatable chamber and behind said hub, a section in flatened form which is parallel to the hollow shaft, which envelopes a part of the periphery of said hollow shaft and which comprises on its inner face and at the front end liquid fuel injection orifices.

5. A polyvalent incinerator for solid and/or liquid waste comprising a vertical combustion chamber provided with an opening for the evacuation of ashes fitted with a grate and located in the bottom of said chamber; with an opening for loading solid wastes; with a chimney shaft; and with a burner; in which said grate is composed of stationary bars, parallel to one another, and of a rotary shaft perpendicular to said stationary bars, which carries radial arms which are diametrically opposite and which are located in the spaces between said stationary bars.

6. An incinerator as claimed in claim 5, in which said opening for the evacuation of the ashes is circular, said rotary shaft is disposed along a diameter of said ash evacuating opening and said stationary bars are located on one side only of said rotary shaft and on the same side as said opening for the loading of the solid waste.

7. A polyvalent incinerator for solid and/or liquid waste comprising a combustion chamber provided with an opening for the evacuation of ashes; with a chimney shaft; with a single burner; and with a loading opening for the loading of solid waste, wherein said opening for the loading of solid waste is provided with a loading chamber comprising a cylindrical sector in the form of a quarter cylinder which pivots about an axis located along the lower end of said loading opening, a door which is pivoted about the same axis and which obturates the outer end of said loading chamber and enables the waste to be introduced into said loading chamber, and a pneumatic jack, which causes said loading chamber to pivot towards the outside of said loading opening so that the solid waste which has been introduced into said loading chamber falls into said combustion chamber.

8. A polyvalent incinerator for solid and/or liquid waste comprising a combustion chamber provided with an opening for the evacuation of ashes; with a chimney shaft; with a single burner; and with a loading opening for the loading of solid waste, wherein said combustion chamber is composed of two metallic envelopes which delimit therebetween a free intermediate space in which a stream of fresh air circulates and of a thin refractory coating located on the inner face of the inner envelope, and the upper end of said combustion chamber is obturated by a dismountable top which comprises, on the one hand, a refractory ring which is placed on the upper edge of said inner refractory coating and which delimits a central, circular, truncated opening whose apex is directed downwardly and, on the other hand, a truncated refractory stopper which is placed in said truncated opening and which carries a central shaft.

* * * * *